US005224607A

United States Patent [19]

Koresko

[11] Patent Number: 5,224,607

[45] Date of Patent: Jul. 6, 1993

[54] SWIVELLING BOOT HANGER

[76] Inventor: John J. Koresko, P.O. Box 3152, Hollywood, Calif. 90028

[21] Appl. No.: 824,046

[22] Filed: Jan. 23, 1992

[51] Int. Cl.[5] ..... A47F 7/00

[52] U.S. Cl. ..... 211/34; 211/116; 248/339

[58] Field of Search ..... 211/34, 116, 115; 248/339

[56] References Cited

U.S. PATENT DOCUMENTS

| | | | |
|---|---|---|---|
| 283,418 | 8/1883 | Ries | 211/34 X |
| D. 292,735 | 11/1987 | Shay | D6/317 |
| D. 317,077 | 5/1991 | Schulz | D2/642 |
| 2,267,634 | 12/1941 | Arnez | 211/34 |
| 2,294,607 | 9/1942 | Peck et al. | 211/34 |
| 2,703,651 | 3/1955 | Brocklehurst | 211/34 |
| 4,192,424 | 3/1980 | Allsop | 211/37 |
| 4,306,661 | 12/1981 | Allsop | 211/37 |
| 4,460,094 | 7/1984 | Schoen | 211/35 |
| 4,576,290 | 3/1986 | Zigman | 211/34 |
| 4,669,615 | 6/1987 | Zigman | 211/34 |
| 4,739,912 | 4/1988 | Klawieter et al. | 211/115 X |
| 4,779,742 | 10/1988 | McKinnon | 211/35 |
| 4,823,962 | 4/1989 | Arias | 211/34 |
| 4,953,715 | 9/1990 | Celli | 211/37 |
| 4,967,913 | 11/1990 | Bayer | 211/38 |
| 5,065,871 | 11/1991 | Chan | 211/37 |

*Primary Examiner*—Robert W. Gibson, Jr.

[57] ABSTRACT

A swivelling hanger for suspending western-style boots or related footwear from various supports, and which consists of an elongate stem with a upper hook portion allowing the hanger to be suspended from a variety of objects and a lower support portion which has two arms parallel to each other, and perpendicular to the elongate stem, that engage and hold the boots by their loops, and an integral arrangement in the elongate stem for joining the two portions and which also allows either of the hanger portions to rotate on the axis of the elongate stem 360 degrees, thus allowing the hook to be facing in one direction while the support arms face in any other direction thus multiplying the hanger's utility where space or other constraints would restrict application of the prior art, and thus further broadening the range of use of the hanger.

3 Claims, 1 Drawing Sheet

Fig. 1.
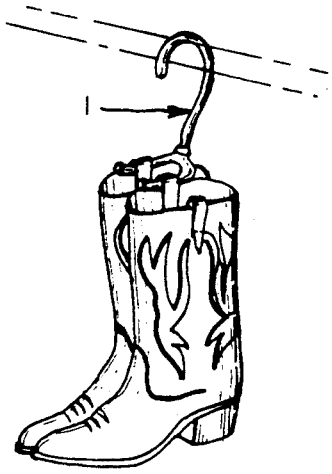
Fig. 2.
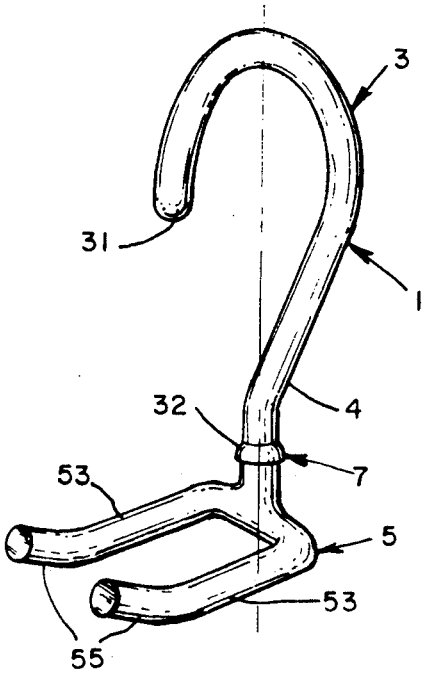
Fig. 3.
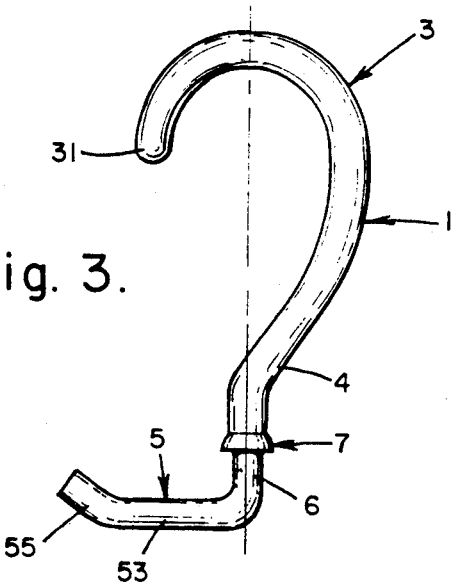
Fig. 4.
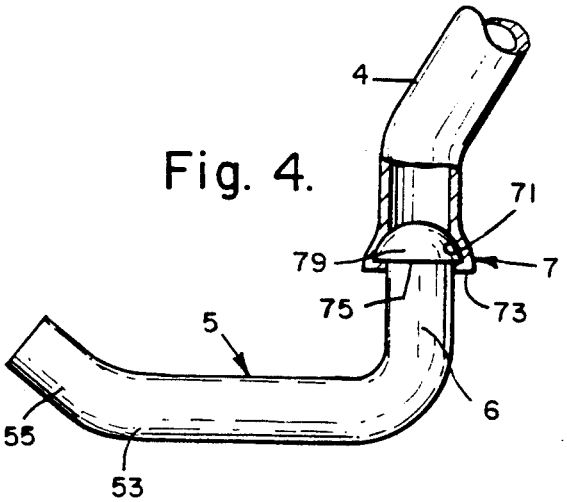
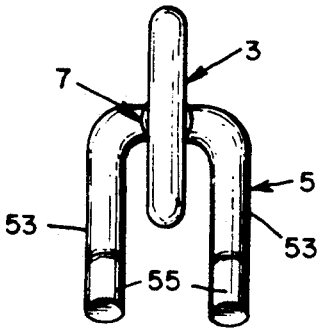
Fig. 5.
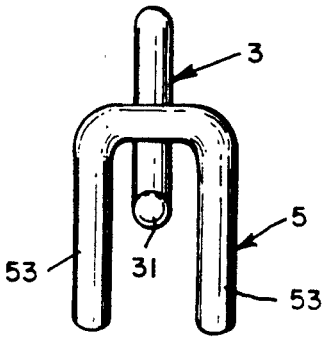
Fig. 6.

SWIVELLING BOOT HANGER

BACKGROUND OF THE INVENTION

1. Field of the Invention

The present invention relates to a hanger for suspending boots from a plurality of supports. It is more suited to western-style boots which are designed with two loops mounted at their top where fingers or a special tool is inserted to assist in pulling on the boot itself. The present invention is adaptable for suspending other types of footwear having a similar design characteristic; namely, loops at the top of such footwear. The present invention is not limited to the materials from which it can be made, but ABS-type plastic appears favored in terms of production and cost, and durable in terms of strength. However, metal, wood, plastic, or combinations thereof, are feasible.

More specifically, the present invention relates to a method for storing, displaying, or transporting western-style boots and related footwear in such a manner as to allow the boots to be stored, displayed or transported "free-hanging," on a plurality of supports, thereby protecting them from detrimental environmental or physical abuse. While the present invention is described herein with reference to illustrative embodiments for particular applications, it should be understood that the invention is not limited thereto.

Those having ordinary skill in the art and access to the teachings provided herein will recognize additional applications, modifications and embodiments within the scope thereof and additional fields in which the present invention would be of significant utility.

2. Description of the Relevant Art

Presently, the ways in which to store, display or transport western-style boots and related footwear are limited. In the case of one type of related footwear—work boots; they are generally displayed on a shelf or counter and by their nature and contruction do not lend themselves to careful storage or transport after use.

Western style boots are at the other end of the spectrum. They are ususally made of high grade leather and often made of extremely expensive materials such as Rhinocerous, Ostrich, Iguana, Snakeskin, etc. The exotic materials often used in best-grade western boots are only limited by the cost the market will bear and the availability of the desired material. Such exotic boots can cost more than $1,000 per pair.

The present invention is also suited for riding and "hunt" boots which consist of extremely long barrels that cover the legs up to the knee; and which also is usually made of supple and expensive leathers. Methods for storing or displaying these special boots, before the present invention were limited. Boots were placed on flat surfaces of store counter tops, racks, or even the floor for display. After purchase, boots were often placed on a floor for storage or during non-wear. One problem with this method is that boots have a tendency to droop to one side from the weight of the boot top, or barrel, and be damaged when a crease develops in that portion of the boots above the reinforced heel portion. This particular problem was generally solved when boot owners started placing rolled up newspapers, magazines, and the like inside each one of the boots to keep the barrels upright. While this was a partial solution, another problem remained. Good quality boots were often accidently stepped on, thereby scuffing and damaging them. Additionally, another problem remained. Ease of transport of the boots, when they were not being worn, existed until the present invention. In order to transport western-style boots and related footwear, the boots have to be placed within a protecive container, otherwise, the above-mentioned damage could occur.

Present methods available for displaying or storing western-style boots and related footwear are limited in their scope and use; and for ease of transport they're virtually non-existent. For example:

U.S. Pat. No. 4,967,913, issued Nov. 6, 1990 to Bayer discloses a FOLDABLE FOOTWEAR SUPPORT DEVICE which can be in a completely folded condition so as to fit in a packaging container or in a partially folded condition consisting of right and left pouches attached on respective panels and suspended from a rigid support bar having a hook means for engaging a support.

U.S Pat. No. 4,953,715, issued Sep. 4, 1990 to Celli discloses a BOOT SUPPORT comprising a base, an upright portion generally perpendicular thereto, and two cantilevered slideable horizontal arms on the uprights with attached clamps for engaging the tops of a variety of boots. The horizontal arms slide up and down on the uprights to match the height of the boots and are held in place by the weight of the boots exerting pressure on the cantilevered slides and arms.

U.S. Pat. No. 4,823,962, issued Apr. 25, 1989 to Arias discloses a SHOE DISPLAY AND STORAGE HANGER for shoes for mounting on substantially horizontally extending rods, having a U-shaped tongue member mounted on an elongated member in an upward direction for insertion into the shoe opening, and having a end of the elongated member terminating in a hook means for mounting on said rods.

U.S. Pat. No. 4,779,743, issued Oct. 25, 1988 to McKinnon discloses a BOOT RACK FOR WESTERN BOOTS WITH SIDE ATTACHED PULLSTRAPS having generally a wall-mounting bracket with a plurality of wire supports extending therefrom perpendicularly to engage said side attached pull straps.

U.S. Pat. No. 4,669,615, issued Jun. 2, 1987 to Zigman discloses a FOOTWEAR HANGER; a dual coil hanger for suspending footwear in an inverted position by means of a wire frame with tensioned clamps thereon to capture the heels of the footwear, and a wire hook means with an eye lower end engaged by the wire frame, at a balance point, to suspend it from a support.

U.S. Pat. No. 4,576,290, issued Mar. 18, 1987 to Zigman discloses a GRIP HANGER; a single coil hanger of essentially the same capture method as Zigman '615 for suspending footwear in an inverted position.

U.S Pat. No. 4,460,094, issued Jul. 17, 1984 to Schoen discloses an ARTICLE HOLDING DEVICE for supporting and storing small articles, such as one shoe, or the like on a generally vertical surface comprising at least one elongate support member adapted to be secured to said vertical surface in an upright position for engaging a portion of the shoe.

U.S. Pat. No. 4,306,661, issued Dec. 21, 1981 to Allsop discloses a SHOE MOUNTING AND DISPLAY APPARATUS comprising a base member defining a slideway having two inwardly facing channel members defining related channels and a plurality of brackets adapted to engage said slideway, comprising two laterally spaced arm members to engage the soles of shoes.

U.S. Pat. No. 4,192,424, issued Mar. 11, 1980 to Allsop discloses a SHOE DISPLAY APPARATUS particularly adapted to display articles such as pairs of shoes in an upright position and in a side by side relationship by means of a mount, an upright support and a plurality of support platforms perpendicular to said upright support.

U.S. Des. Pat. No. 292,755, issued Nov. 17, 1987 to Shay discloses a BOOT HANGER.

The primary deficiencies with the related art are that they are not adaptable to a plurality of support applications, nor, except in the case of Bayer '913 wholly and conveniently portable, being limited to permament positioning on a wall or moveable placement on a level surface. Bayer '913 is distinguishable.

Bayer '913 teaches a collapsible footwear device partially made of soft material which can be folded up when not in use. This enables easy transportation and storage of the device. However, since Bayer relies on pouches to receive the footwear, it is not suitable for boots of the type covered by the present invention.

Celli '715 teaches a boot support which is limited to placement upon flat and level surfaces. Celli might have found further application by claiming a means for mounting on a wall surface which would have broadened its application.

Arias '962 teaches a shoe display and storage hanger which is essentially limited to "low cut" shoes, thereby not suitable to the boots and related footwear covered by the present invention.

The deficiency found in Celli was overcome by McKinnon '743 which teaches a boot hanger which is wall mounted and allows a wider application in terms of placement and protection, by means of the above-floor support. This device too, however, is also limited in that it cannot be moved to another location without first mechanically removing it from the surface it is attached to and and then mechanically re-installing it at another location. It is further limited in that it accepts multiple multiple pairs of boots, making it not feasible to transport a single pair of boots by virtue of the bulk of the device.

Zigman '615, which reads on Zigman '290, discloses a multiple coil footwear hanger with an improved method for capture of footwear; however it does not extend its application to the range of plurality of supports, as does the present invention, nor does it lend itself to storage in a minimum of space as the present invention.

Zigman '290 which discloses a single coil wire footwear hanger with means for hanging footwear by tensioned clamps in an inverted position lends itself to more applications than does Celli or McKinnon, as stated, but its support application range doesn't equal the support application range of the present invention.

Allsop '661 teaches a shoe mounting and display apparatus which is confined to placement on a floor or other flat and level surface, thereby limiting its application to the coverage of the present invention.

Allsop '424 teaches a shoe display apparatus which must be placed upon a flat and level surface, such as a countertop or floor or deep shelf. Allsop is thereby severely limited in scope of application and Alsop has no convenient portability.

Huan-Yin Chan '871 teaches a relatively stationary floor or level surface rotary shoe rack. The bulk and complexities of this device prevents it from the same function and portability as the present invention.

Shay Design Patent '755 teaches a wire hanger having support arms and a hook means for engaging a support. Shay is the only related art of significance in regard to the present invention. However, Shay is not read on by the present invention, as appears more fully below.

Schulz Design Patent '077 teaches a wire-framed device with triangular sides connected at their base with a "vee" and single bar. The obvious function of this device is to assist in removing boots from the wearer's feet. The function of the hooks appear to be used to assist in installation of a single boot, and is not read on by the present invention. sides have Zigman '290 and '615 and Shay D'775 can find application to a plurality of supports only if said supports are on a plane perpendicular to the dictated direction of its hook means, which limits the direction of said hook which is not pivotal, and thereby does not allow for capture of multi-positioned supports within the range of the present invention. Further, Zigman '290 and '615 teach a rigid support bar and support means which do not allow convenience of storage in a small container like a glove box of a vehicle, or a limited space like a jacket pocket or other small container, as found with the present invention.

Like Zigman '290 and '615, Shay D'775 has a hook configuration which is not pivotal, and thereby does not teach the novelty of the present invention. The present invention is intended to be used in almost any conceivable position or support due to its swivel feature. At the present time, there is no method available to safely and conveniently store or display western-style boots and related footwear without first having to resort to additional effort; for example, mechanically installing racks and mountings. Also, the present methods of displaying and/or storing the relevant boots are bulky, and do not lend themselves to transport use by their very construction limitations.

The Zigman devices display (but doesn't claim) a portable footwear hanger, but the rigid construction of the Zigman devices limit their use. The present invention does what the present art does not. The present invention makes it possible to display, store, and/or transport western-style boots and related footwear wherever there is a support which accepts the suspension portion of the invention; such as a clothes closet rod, a door knob, a drawer pull, the open window of a pickup truck, etc. due primarily to its swivel feature, in an easy and safe manner.

The present invention eliminates the need for rolled up newspapers or magazines, and for wall mounted or floor mounted racks and supports, prevents accidental damage from scuffing by being stepped on, and allows for total portability and, by its size, occupies and/or utilizes a minimum of space when the invention is not in use.

OBJECT OF THE INVENTION

It is a primary object of the invention to provide a portable boot hanger which is able to be utilized in more and efficient ways than the available art by means an integral swivel which allows the boot hanger to be placed and secured anywhere where there is a support which will receive the suspension portion of the invention in order to suspend the boots engaged by it.

It is a further object of the invention to provide an apparatus which is simple to manufacture, easy to use, inexpensive, and convenient to store when the invention is not in use.

SUMMARY OF THE INVENTION

This invention provides a hanger for suspending at least one or more western-style boots or related footwear from a plurality of supports and comprises an elongate stem having a upper suspension portion and a lower support portion, and means for securely joining said portions, and adapted for swivel engagement.

An upper suspension portion having a first end and a second end. Said first end provided with an arc of at least 180° and not more than 270° forming a hook for releasably engaging a plurality of supports, such a closet clothes bar, a doorknob, a drawer pull, open window of a pick-up truck, etc. Said second end having a preferred cavity in said elongate stem for pivotably and firmly receiving the connector end of the elongate stem of the second portion, and means for swivelably connecting and securing said two portions.

A lower support portion comprising an elongate stem comprising a connector end and a support end. Said support end having a pair of parallel arm members extending outward from the elongate stem member, said arm members extending oppositionally in a preferred angle from the elongate stem member thence perpendicular to both the said stem member and the opposing arm members in a preferred angle from said member, with said arm members parallel to each other and terminating in a preferred upward angle to secure the boot loops while engaged on said parallel arm members; said connector end comprising a means for swivelly connecting said support portion to said upper portion elongate stem cavity, and secured by engagement of the connector end shoulder with the lip of the suspension portion cavity.

BRIEF DESCRIPTION OF THE DRAWINGS

FIG. 1 shows a perspective view of the swivel hanger engaging a pair of western-style boots and suspending them from a bar-support.

FIG. 2 shows an elevational perspective view of said swivel hanger, depicted in FIG. 1.

FIG. 3 shows a side view of said swivel hanger.

FIG. 4 shows a sectional view of the hanger swivel means with the pivotal connector engaged within the elongate stem cavity. Also shown is secure engagement of said connector end shoulder of the support portion by the lip of the suspension portion cavity.

FIG. 5 is a top plan view thereof with the hook portion aligned with the support portion arm members.

FIG. 6 is a bottom plan view thereof with the hook portion aligned with the support portion arm members.

DETAILED DESCRIPTION OF THE PREFERRED EMBODIMENT

This invention provides a hanger (1) for suspending at least one or more western-type boots or related footwear from a plurality of supports and comprises an elongate stem (4) having a upper suspension portion (3) and a lower support portion (5), and means (7) for securely joining said portions, and adapted for swivel engagement.

An upper suspension portion (3) having a first end (31) and a second end (32). First end (31) provided with an arc of at least 180° and not more than 270° forming a hook (3) for releasably engaging a plurality of supports, such a closet clothes bar, a doorknob, a drawer pull, open window of a pick-up truck, etc. Said second end (32) having a preferred cavity (71) in said elongate stem (4) for pivotably and firmly receiving and securing the connector end (79) of the second portion (5), and means for swivelably connecting and securing said two portions (7).

A lower support portion (5) comprising an elongate stem (6) comprising a connector end (79) and a support end (53). Said support end (53) having a pair of parallel arm members (53) extending outward from the the elongate stem member (6), said arm members extending oppositionally in a preferred angle from the elongate stem member (4) thence perpendicular to both the said stem member and the opposing arm members in a preferred angle from said member, with said arm members (53) parallel to each other and terminating in a preferred upward angle (55) to prevent the boot loops from slipping off said parallel arm members (53) while engaged thereon; said connector end (79) comprising a means for swivelably connecting said support portion (5) to said suspension portion (3) where a plurality of arm members (53) emanate therefrom in a preferred embodiment. The upper suspension portion elongate stem cavity (71) is engaged with the lower support connector end (79) of the elongate stem (4) allowing said cavity (71) to pivotably receive said connector means (79) and be secured therein through engagement of the connector end shoulder (75) by the lip (73) of the elongate stem cavity of the suspension portion. Accordingly,

What is claimed is:

1. A swivelling hanger for western-style boots and other related footwear which have loops at their tops, comprising:

an elongate stem having an upper suspension hook portion and a lower support arms portion, the elongate stem lower support arms portion having a first and a second end, the first end forming a pair of support arms comprising two arms parallel to each other and perpendicular to said elongate stem for releasably receiving and securing the loops of western-style boots or related footwear thereon, and, the second end having a swivel connector adapted to engage said upper suspension hook portion of said elongate stem for connecting and securing said hook portion to said arms portions to allow for free and full rotation of either said hook portion or said arms portion independent of the other in a 360 degree circle.

2. A swivelling hanger for boots which have loops at their tops, especially western-style boots and related footwear, comprising:

an elongate stem having an upper suspension portion and a lower support portion;

said upper suspension portion having a first end from which an arc of at least 180 degrees and no more than 270 degrees emanates and forms a hook for application to a plurality of supports, and, on a second opposite end, a cavity adapted to receive and secure therein in a swivelling manner a connector end of the lower support portion by means of a lip which abuttingly engages a connector shoulder of the lower support portion after insertion therein of said connector end into said cavity.

3. A swivelling hanger for boots which have loops at their tops, especially western-style boots and related footwear, comprising:

an elongate stem having an upper suspension portion and a lower support portion, said upper suspension portion having a first end from which an arc of at least 180 degrees and no more than 270 degrees emanates and forms a hook for application to a plurality of supports, and, on a second opposite end, a cavity adapted to receive and secure therein in a swivelling manner a connector end of the lower support portion by means of a lip which abuttingly engages a connector shoulder of the lower support portion after insertion therein of said connector end into said cavity, said lower portion of said elongate stem having an elongate body member comprising a connector end and a support end, said connector end having a shaped head with a shoulder for securely connecting said connector end to the cavity end of the upper suspension portion of said elongate stem in a manner allowing secure joining and swivelling between said upper suspension portion and said lower support portion of said elongate stem.

* * * * *